United States Patent [19]

Ishii

[11] Patent Number: 4,835,529

[45] Date of Patent: May 30, 1989

[54] OUTPUT DISPLAY APPARATUS

[75] Inventor: Hiroshi Ishii, Hamura, Japan

[73] Assignee: Kabushiki Kaisha Toshiba, Kawasaki, Japan

[21] Appl. No.: 165,347

[22] Filed: Feb. 29, 1988

Related U.S. Application Data

[63] Continuation of Ser. No. 792,561, Oct. 29, 1985, abandoned.

[30] Foreign Application Priority Data

Oct. 30, 1984 [JP] Japan ..... 59-228532

[51] Int. Cl.[4] ..... G09G 1/00

[52] U.S. Cl. ..... 340/721; 340/734; 340/747; 340/748

[58] Field of Search ..... 340/721, 734, 744, 747, 340/748, 750

[56] References Cited

U.S. PATENT DOCUMENTS

| | | | |
|---|---|---|---|
| 4,149,184 | 4/1979 | Giddings et al. | 340/730 |
| 4,470,042 | 9/1984 | Barnich et al. | 340/721 |
| 4,490,797 | 12/1984 | Staggs et al. | 340/721 |
| 4,599,611 | 7/1986 | Bowker et al. | 340/721 |
| 4,613,852 | 9/1986 | Maruko | 340/747 |
| 4,684,935 | 8/1987 | Fujisaku et al. | 340/721 |
| 4,686,521 | 8/1987 | Beaven et al. | 340/748 |

*Primary Examiner*—Donald J. Yusko
*Assistant Examiner*—Jeffery A. Brier
*Attorney, Agent, or Firm*—Finnegan, Henderson, Farabow, Garrett & Dunner

[57] ABSTRACT

An apparatus stores one set of dots which represents a graphic pattern and a second set of dots which represents an alphanumeric pattern. According to a distinction code, the patterns are either combined in an OR-WRITE mode, in which the two patterns are logically added in a common portion, or in an OVER-WRITE mode, in which the second pattern replaces the first pattern in the common portion.

8 Claims, 2 Drawing Sheets

OUTPUT DISPLAY APPARATUS

This application is a continuation of application Ser. No. 792,561, filed Oct. 29, 1985, now abandoned.

BACKGROUND OF THE INVENTION

The present invention relates to an output apparatus designed to display or print information, such as, characters and graphics, by way of a dot pattern in a matrix configuration.

Generally, in an output apparatus designed to display or print such information by way of a dot pattern in a matrix configuration, character and graphic information, or graphic information and graphic information, are often desired to be output to the same position. One case in which this occurs is, where characters are desired to be written into each oblique-line part of a circle graph. The following two output modes are contemplated as satisfying such a desire.

One output mode is a so-called OR-WRITE mode in which, as shown in FIG. 1, a dot pattern representing oblique lines, and another dot pattern representing a character are logically added together and overlapped one upon the other. The other output mode is a so-called OVER-WRITE mode in which, as shown in FIG. 2, a graphic dot pattern (an oblique line pattern), in a matrix area corresponding to one in which a character dot pattern is to be written, is erased and the character dot pattern is written into the erased matrix area.

In a conventional output apparatus, either one of the output modes was alternatively adopted. For this reason, it was impossible to selectively use the above-mentioned two output modes type of characters or to the required quality of output information. Thus, the outputted character often failed to be clearly deciphered.

SUMMARY OF THE INVENTION

The object of the invention is to provide an output apparatus designed to display or print information, such as characters and graphics in the form of a dot matrix, whose output mode can optionally be set to either the OR-WRITE or OVER-WRITE mode when two items of information are output into the same position.

The above object can be attained in accordance with the present invention by an output apparatus comprising: first means for storing a first dot pattern to be output, second means for storing a second dot pattern to be output in the same position as said first dot pattern, third means for storing an OR-WRITE/OVER-WRITE distinction code indicating whether said second dot pattern is "or-written" or "over-written" with respect to said first dot pattern, fourth means which, in the case where said distinction code stored in said third means is an OR-WRITE distinction code, logically adds said first and second dot patterns, stored respectively in said first and second means, and stores the resultant dot pattern in said first means as a new first dot pattern, and which, in the case where said distinction code stored in said third means is an OVER-WRITE distinction code, stores said second dot pattern in said first means as a new first dot pattern; and fifth means for outputting said first dot pattern stored in said first means.

DETAILED DESCRIPTION OF THE PREFERRED EMBODIMENTS

Figure 3:
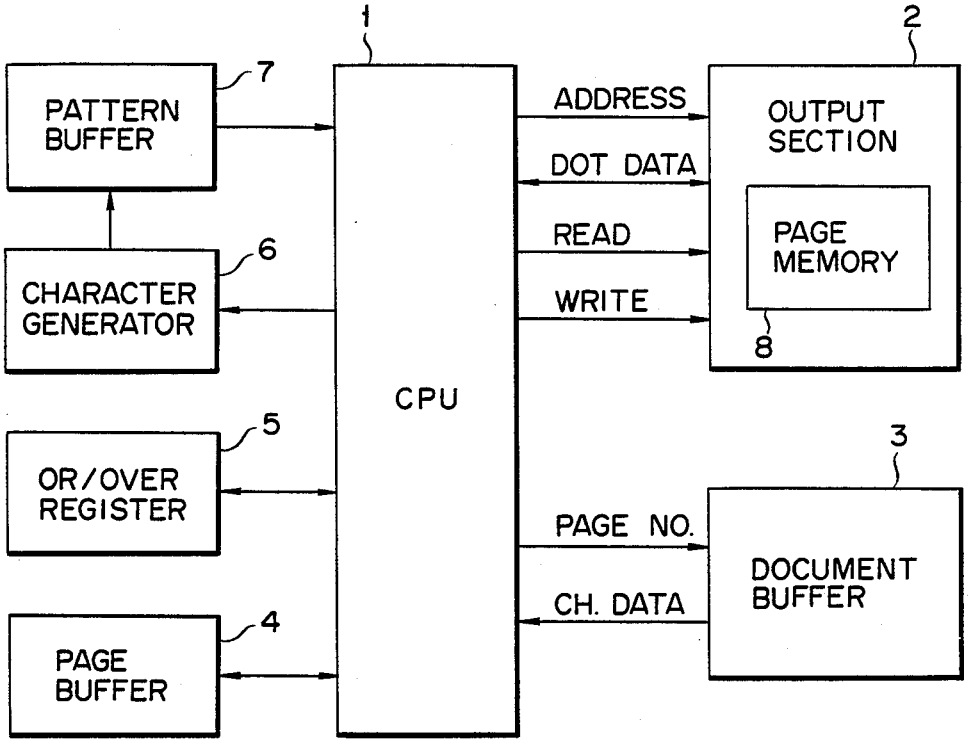
FIG. 3 is a block diagram showing the output apparatus according to an embodiment of the invention.

An output apparatus according to an embodiment of the invention will now be described with reference to the accompanying drawings. FIG. 3 is a block diagram of the preferred embodiment of this invention. In FIG. 3, Central Processing Unit 1 (hereinafter referred to simply as "CPU") for controlling the entire output operation is provided. To this CPU 1 is connected an output section 2 including a printer, a display, or the like, whose output section has a page memory 8 capable of storing dot patterns corresponding to one page. When address signals for designating the row and column addresses (hereinafter, the row and column addresses of the page memory 8 are collectively referred to simply as "addresses") of the page memory 8, as well as a read signal, are supplied from CPU 1 to the output section 2, dot data indicating the state of a dot corresponding to the addresses designated in the output section 2 is read and transferred to CPU 1. A dot to be output is conventionally a "1" and a dot which is not output (i.e., displayed or printed) is conventionally a "0" when the address signals of the page memory 8, the dot data and a write signal are supplied from CPU 1 to the output section 2, the dot data is written into the location corresponding to the addresses designated in the output section 2, so that the state of the dot in said location is refreshed. Further, when an output command signal is supplied from CPU 1 to the output section 2, the dot data in the page memory 8 is output and the corresponding printing or display is effected.

Also connected to CPU 1 is a document buffer 3 in which there are stored character data of the whole document, the character data consisting of code data of characters and graphics and OR/OVER distinction codes used to designate "OR-WRITE" or "OVER-WRITE". When a page number signal is supplied from CPU 1 to the document buffer 3, the character data in the corresponding page is transferred to CPU 1.

A page buffer 4 storing character data corresponding to one page, and an OR/OVER register 5 storing OR-/OVER distinction codes separated from the character data, are also connected to CPU 1.

Further, a pattern buffer 7 as well as a character generator 6 are also connected to CPU 1. When a character code is supplied from CPU 1 to the character generator 6, a dot pattern representing the corresponding character is transferred to the pattern buffer 7 from the character generator 6.

Figure 4:
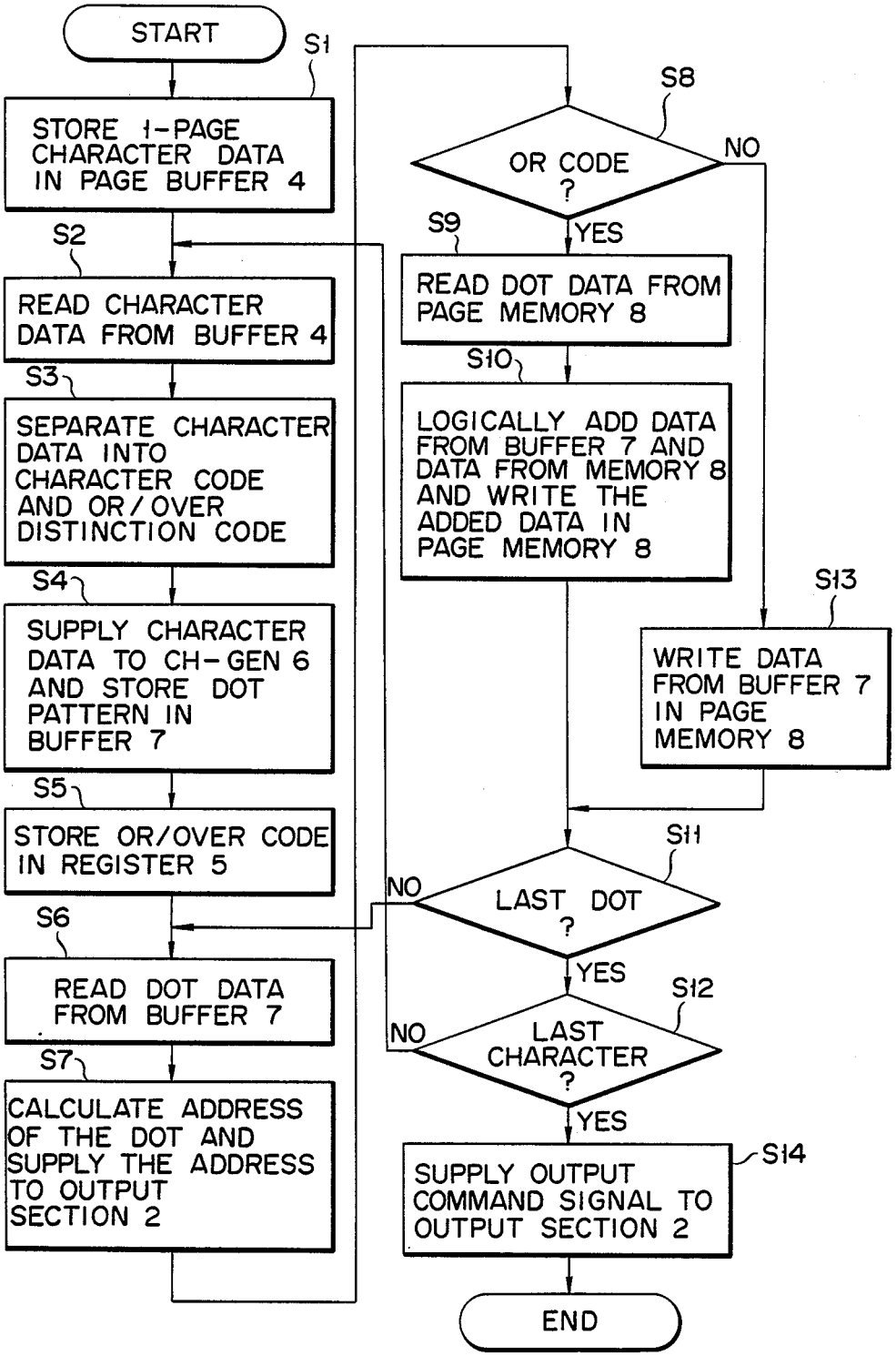
FIG. 4 is a flow chart showing the operation of the output apparatus according to the embodiment of the invention.

Next, the operation of the output apparatus in accordance with this embodiment of the invention will be described with reference to FIG. 4. FIG. 4 is a flow chart showing the operation of the CPU 1 which starts from a state wherein dot pattern data with, for example, graphics other than characters are already set in the output section 2. In the process of FIG. 3, CPU 1 then proceeds to output character corresponding to one page with respect to the dot pattern of the graphics. CPU 1 supplies a page number signal indicting the number of the page containing character data to be output to the document buffer 3. The document buffer 3 delivers to CPU 1 the character data from the page corresponding to the page number signal. CPU 1 delivers to the page buffer 4 the 1-page character data input to CPU 1 from the document buffer 3. The page buffer 4 stores the 1-page character data supplied to it from CPU 1. The character data readout operation up to this point of operation is executed in step S1 of FIG. 4.

In step S2, an initial character data is supplied from the page buffer 4 to CPU 1. In step S3, CPU 1 separates the input character data into a character code data and an OR/OVER distinction code. In step S4, CPU 1 supplies the character code to the character generator 6 which then supplies to the pattern buffer 7, for storage in the pattern buffer 7, the dot pattern of a character corresponding to the input character code. In step S5, CPU 1 supplies an OR-OVER distinction code to the OR/OVER register 5, which stores the input OR-/OVER distinction code. In step S6, CPU 1 reads the dot data from the pattern buffer 7. In step S7, CPU 1 calculates an address of the dot read in step S6, and supplies that address to the output section 2.

Next, in step S8, CPU 1 reads an OR/OVER distinction code from the OR/OVER register 5 to decide whether this distinction code is an OR distinction code or an OVER distinction code. If the distinction code is an OR distinction code, the operation proceeds to step S9. If the distinction code is an OVER distinction code, the operation goes ahead to step S13.

Figure 1:
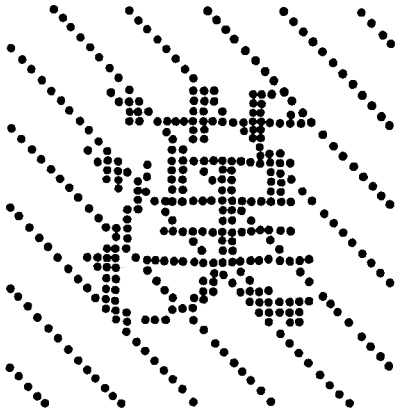
FIG. 1 shows the OR-WRITE output mode which is one output mode of an output apparatus according to the invention.

For the OR-WRITE mode beginning with step S9, CPU 1 supplies a read signal to the output section 2. In response to the address supplied in step S7 from CPU 1 and the read signal supplied in step S9 from CPU 1, the output section 2 supplies to CPU 1 the data of a dot corresponding to the input address. In step S10, CPU 1 logically adds the dot data read in step S6 from the pattern buffer 7 and the dot data read in step S9 from the output section 2. CPU 1 supplies the dot data shown in FIG. 1, obtained as a result of the logical addition, to the output section 2. Next, CPU 1 supplies a write signal to the output section 2. Thus, the dot data is renewed. Thereafter, the operation proceeds to step S11.

Figure 2:
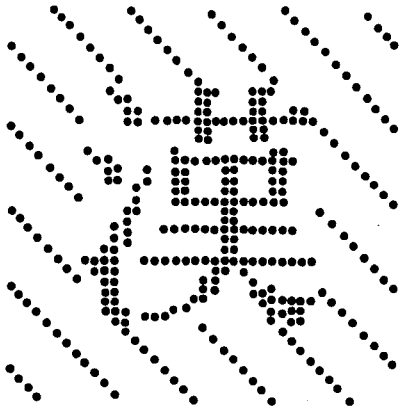
FIG. 2 shows the OVER-WRITE output mode which is another output mode of the output apparatus according to the invention.

For the OVER-WRITE mode beginning with step S13, CPU 1 supplies to the output section 2 the dot data supplied in step S6 from the pattern buffer 7. Next, CPU 1 supplies a write signal to the output section 2. Thus, the dot data supplied in step 6 from the pattern buffer 7 is set in the output section 2 as the data of the dot corresponding to the addresses. At this time, the dot data indicating the graphic which is already in the output section 2 is erased, as shown in FIG. 2. The operation then proceeds to step S11.

In step S11, CPU 1 decides whether the dot data read in step S6 from the pattern buffer 7 is the last one of the dots representing one character. If so, then the operation proceeds to step S12. If not in which and, the operation goes back to step S6, in which the next dot is read from the pattern buffer 7 into CPU 1. In this way, the operations of steps S6 to S11 (or S13) are repeatedly carried out until the last one of the dots representing one character is read into CPU 1.

In step S12, CPU 1 decides whether the character input in step S2 from the page buffer 4 is the last one of the characters of one page. If so, then the operation proceeds to step S14. If not, the operation returns to step S2, in which the next character is read from the page buffer 4 into CPU 1. Again, the operations of the steps S2 to S12 are repeatedly performed in this way until the last character of one page is read into CPU 1.

In step S14, CPU 1 supplies an output command signal to the output section 2, so that the 1-page dot data in the page memory 8 is read out and the printing or display thereof is effected.

As described above, according to this embodiment, distinction between the OR-WRITE mode and the OVER-WRITE mode, and the resultant dot-pattern processing under the OR-WRITE mode or OVER-WRITE mode, is performed per character. Although in the foregoing description the dot pattern was processed for each dot, it is to be noted here that it is also possible to process several dots at one time to increase the processing speed, if, in step S6, several dots are read at once rather than individually. Further, although the OR-/OVER distinction code was added to each character as an attribute data, an OR/OVER distinction code may also be inserted before the character, with respect to which the operation changes from the OR-WRITE to the OVER-WRITE mode, or vice versa. Further, two patterns which are output in an overlapped fashion are not limited to a combination of character and graphic. That is, character and character, graphic and graphic may also be combined.

As has been described above, according to the invention there is provided an output apparatus which comprises both an OR/OVER designating means for designating the OR-WRITE or OVER-WRITE mode with respect to each character used as a minimal unit to be output, and means for causing a dot pattern to be "or-written" or "over-written" in accordance with the designation made by the OR/OVER designating means; whereby, when two items of information such as character, graphic, etc,. each expressed in the form of a dot matrix, are output into the same position, either the OR-WRITE or OVER-WRITE mode can be optionally used as the information output mode, making it possible to obtain an optimum pattern at all times.

What is claimed is:

1. An apparatus for producing a set of dots as an output from two patterns, said apparatus comprising:

first storage means for storing a first set of dots representing a first one of said patterns as a graphic pattern;

second storage means for storing a second set of dots representing a second one of said patterns as an alphanumeric pattern different from said first pattern, said second pattern covering a common portion of said first pattern in said output;

third storage means for storing an OR-WRITE/OVER-WRITE distinction code indicating either an OR-WRITE mode, in which said second pattern is to be logically added to said first pattern in said common portion, or an OVER-WRITE mode, in which said second pattern is to replace said first pattern in said common portion;

pattern forming means, coupled to said first, second, and third storage means, for logically adding said first and second sets of dots and storing a resultant set of dots into said first storage means when said OR-WRITE/OVER-WRITE distinction code indicates an OR-WRITE mode, and for storing said second set of dots into locations in said first storage means corresponding to the common portion when said distinction code indicates an OVER-WRITE mode; and output means for outputting the set of dots stored in said first storage means by said pattern forming means wherein said second pattern includes a plurality of second dot patterns corresponding to different sets of dots.

2. An output apparatus according to claim 1, in which said third storage means includes said distinction code for each of said second dot patterns.

3. An output apparatus according to claim 1, in which said third storage means includes as said distinction code an indication of a change between said OR-WRITE mode and said OVER-WRITE mode.

4. An output apparatus according to claim 1, in which said pattern forming means includes means for forming said second set of dots for said first pattern for each different set of dots of said second pattern.

5. An output apparatus according to claim 1, in which said pattern forming means includes means for forming said second set of dots for said first pattern for each of several of said first patterns.

6. A method for superposing a first pattern, which is a graphic pattern, onto a second pattern, which is an alphanumeric pattern different from said graphic pattern, the second pattern being stored as a second dot pattern in a page memory, the method comprising the steps of:

generating a first dot pattern corresponding to the first pattern;

setting a mode distinction code indicting how the first pattern is to be superposed on a second dot pattern corresponding to the second pattern;

calculating an address of said page memory indicating where the first dot pattern should be superposed on the second dot pattern;

storing into the page memory at the calculated address the logical addition of the first dot pattern and the second dot pattern if the mode distinction code is set at a first value; and storing the second dot pattern into the page memory at the calculated address if the mode distinction code is set at a second value.

7. A method according to claim 6, in which said setting step comprises a substep of setting the mode distinction code with respect to each second dot pattern.

8. A method according to claim 6, in which said setting step comprises a substep of setting the mode distinction code for each second dot pattern for which the mode distinction code changes between the first and second values.

* * * * *